US006761213B2

(12) United States Patent
Davidian

(10) Patent No.: US 6,761,213 B2
(45) Date of Patent: Jul. 13, 2004

(54) REBOILER/CONDENSER HEAT EXCHANGER OF THE BATH TYPE

(75) Inventor: Benoît Davidian, Saint Maur (FR)

(73) Assignee: L'Air Liquide—Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 10/368,458

(22) Filed: Feb. 20, 2003

(65) Prior Publication Data

US 2003/0150602 A1 Aug. 14, 2003

Related U.S. Application Data

(62) Division of application No. 09/829,050, filed on Apr. 10, 2001, now Pat. No. 6,622,784.

(51) Int. Cl.[7] ..... F28F 3/00
(52) U.S. Cl. ..... 165/166; 165/165; 165/164
(58) Field of Search ..... 165/10, 112, 113, 165/166, 911, 165, 164

(56) References Cited

U.S. PATENT DOCUMENTS

| | | | | |
|---|---|---|---|---|
| 3,835,920 A | * | 9/1974 | Mondt | 165/81 |
| 4,113,435 A | * | 9/1978 | Lagow et al. | 422/191 |
| 4,557,202 A | * | 12/1985 | Warner | 110/216 |
| 4,582,121 A | * | 4/1986 | Casey | 165/1 |
| 4,599,097 A | | 7/1986 | Petit et al. | |
| 4,617,036 A | | 10/1986 | Suchdeo et al. | |
| 4,715,433 A | * | 12/1987 | Schwarz et al. | 165/110 |
| 5,031,693 A | | 7/1991 | VanDyke | |
| 5,071,458 A | | 12/1991 | Grenier et al. | |
| 5,122,174 A | * | 6/1992 | Sunder et al. | 62/24 |
| 5,167,274 A | * | 12/1992 | Mueller | 165/1 |
| 5,362,454 A | * | 11/1994 | Cizmer et al. | 422/201 |
| 5,613,373 A | | 3/1997 | Grenier | |
| 5,775,412 A | * | 7/1998 | Montestruc, III et al. | 165/134.1 |
| 5,901,574 A | | 5/1999 | Rohde | |

FOREIGN PATENT DOCUMENTS

| | | |
|---|---|---|
| DE | 1 551 583 | 6/1970 |
| FR | 2364423 | 4/1978 |

* cited by examiner

*Primary Examiner*—Henry Bennett
*Assistant Examiner*—Nihir Patel
(74) *Attorney, Agent, or Firm*—Young & Thompson

(57) ABSTRACT

A reboiler/condenser bath heat exchanger for heat exchange between a first fluid to be vaporized and a second fluid to be condensed includes a number of passages for heat exchange between the two fluids in order to make the second fluid flow, which fluid has a temperature of $T_{2-2}$ at the outlet of the passages; a vessel containing the passages for making the first fluid flow between the passages by thermosiphon effect from the bottom upwards over a height h, the first fluid having an entry temperature $T_{1-1}$ where $T_{1-1}<T_{2-2}$ and an exit pressure $P_{1-2}$; elements for giving the entry pressure $P_{1-1}$ of the first fluid a value such that the pressure $P_{1-2}$ is greater than a minimum pressure $P_{m,ex}$ and elements for ensuring that at least one of the following two conditions is fulfilled:

the height h of the passages is at least equal to 2.5 m; and the temperature $T_{2-2}$ of the second fluid is less than $T_{1-1}+1.2°$ C.

8 Claims, 3 Drawing Sheets

REBOILER/CONDENSER HEAT EXCHANGER OF THE BATH TYPE

This application is a division of Application No. 09/829,050, filed on Apr. 10, 2001, now U.S. Pat. No. 6,622,784, the entire contents of which are hereby incorporated by reference.

The subject of the present invention is a reboiler/condenser heat exchanger of the bath type and a heat exchange process in a heat exchanger of the bath type.

More specifically, the invention relates to a reboiler/condenser heat exchanger of the bath type for heat exchange between a first fluid to be vaporized and a second fluid to be condensed, and to the use of this type of heat exchanger. The term "vaporization" is understood to mean partial or complete vaporization and the term "condensation" is understood to mean partial or complete condensation.

This arrangement is used especially, but not exclusively, in air distillation plants of the double-column type in which, for example, liquid oxygen at the bottom of the low-pressure column is vaporized in a bath reboiler by heat exchange with gaseous nitrogen taken from the top of the medium-pressure column.

The operation of bath heat exchangers, because of their intrinsic characteristics, imposes limitations as regards the height for exchange between the first and second fluids or as regards the temperature difference between the primary fluid and the secondary fluid.

This problem will be more clearly understood with reference to the appended FIGS. 1 and 2 which show, on the one hand, an example of a functional diagram showing the operation of a bath heat exchanger and, on the other hand, an example of a functional diagram showing the heat exchange between the primary fluid and the secondary fluid.

FIG. 1 shows, in a simplified manner, the external vessel 10 of the bath heat exchanger, inside which vessel a number of passages 12 for the "warm" second fluid F2 are contained, the said second fluid entering the vessel in the upper part of these passages at 14 and leaving it in the lower part at 16. With regard to the "cold" first fluid F1 to be vaporized, this is contained in the external vessel 10 and flows by thermosiphon effect from the lower end 12*a* of the passages for the second fluid F2 to its upper end 12*b*, the height of this heat exchange region being equal to h.

As the diagram in FIG. 2 shows more clearly, the first fluid F1 at the inlet of the exchange region is at a temperature $T_{1-1}$ and at a pressure $P_{1-1}$. This temperature $T_{1-1}$ and this pressure $P_{1-1}$ correspond to a subcooling state, that is to say correspond to a temperature below the bubble temperature $T_{b1}$ of the fluid F1 at the pressure $P_{1-1}$ because of the hydrostatic pressure due to the head of liquid fluid F1. This will be shown in the above diagram in which $T_b$ denotes the temperature (the bubble temperature) at which the first gas bubble appears in the fluid F1 during the heat exchange (at an intermediate pressure between $P_{1-1}$ and $P_{1-2}$). It will be understood that the energy used to bring the primary fluid to the bubble temperature $T_b$ is "lost" energy, in order to vaporize the first fluid. Also shown in this FIG. 2 is the second fluid F2 with its entry temperature $T_{2-1}$ at which it enters the exchange region 12 and it's exit temperature $T_{2-2}$. It can be seen that the subcooling phenomenon results in a "pinching effect" in the heat exchanges between the two fluids.

Furthermore, the thermosiphon effect, which allows the first fluid F1 to flow, is made possible by the formation of bubbles in the first fluid. If the head in the heat exchanger corresponding to the "desubcooling" phase is too great, the thermosiphon effect will be insufficient.

It will be understood that the greater the height h of the heat exchange region the greater the hydrostatic pressure on the first fluid at the inlet of the exchange region and therefore the greater the subcooling region must be too. To sustain the thermosiphon effect which ensures flow of the first fluid, the "pinching" phenomenon must therefore be limited. In heat exchange plants of the bath type, this height is therefore limited to 2.5 metres.

Another drawback present in this type of bath heat exchanger is that the "pinching phenomenon" described above requires there to be a temperature difference between the entry temperature $T_{1-1}$ of the cold fluid F1 to be vaporized and the temperature $T_{2-2}$ of the warm fluid F2 of more than about 1.2° C. in order to allow the heat exchanger to operate by thermosiphon effect because of the "pinching effect". However, it will be understood that increasing this temperature difference increases the thermodynamic irreversibilities and, consequently, reduces the energy efficiency of the entire plant. For example, in the case of the distillation of the gases contained in the air using a double column, the pressure in the column called the medium-pressure column and, consequently, the pressure in the feed air compressor, must be increased, thereby increasing the energy consumption of the entire plant.

There is therefore a real need for reboiling/condenser heat exchangers of the bath type or for heat exchange processes in a plant of the bath type which make it possible either to increase the vertical heat exchange height, in order to reduce the floor space of the plant, or to reduce the temperature difference between the first fluid and the second fluid, or else to allow a combination of these two characteristics of the reboiler/condenser heat exchanger.

According to the invention, to achieve this objective the reboiler/condenser heat exchanger of the bath type, for heat exchange between a first fluid (F1) to be vaporized and a second fluid (F2) to be condensed, the said heat exchanger, having a minimum exit pressure $P_{m,ex}$ of the said first fluid in order to allow the plant in which the said heat exchanger is mounted to operate, comprises:

means for defining a number of passages for heat exchange between the two fluids in order to make the said second fluid flow, the said second fluid having a temperature $T_{2-2}$ at the outlet of the said passages;

vessel-forming means containing the passage-forming means for making the said first fluid flow by thermosiphon effect between the said passages from the bottom upwards over a height h, the said first fluid having an entry temperature $T_{1-1}$ where $T_{1-1}<T_{2-2}$ and the said vaporized first fluid having an exit pressure $P_{1-2}$;

means for giving the entry pressure $P_{1-1}$ of the said first fluid a value such that the pressure $P_{1-2}$ is greater than the said minimum pressure $P_{m,ex}$ and means for ensuring that at least one of the two following conditions is fulfilled:

the height h of the heat exchange passages is at least equal to 2.5 m; and the temperature $T_{2-2}$ of the said second fluid is less than $T_{1-1}$+1.2° C.

It has in fact been demonstrated that if the exit pressure of the first fluid is,increased, the pinching effect is modified, thereby allowing either the heat exchange height h to be increased or the temperature difference between the two fluids to be decreased.

According to another aspect of the invention, the process for vaporizing a first fluid (F1) using a reboiler/condenser bath heat exchanger comprises the following steps:

a second fluid (F2) is made to flow through vertical exchange passages, the said second fluid having an exit temperature $T_{2-2}$;

the said first fluid is made to flow from the bottom up over a height h by thermosiphon effect between the said heat exchange passages, the said first fluid having an entry temperature $T_{1-1}$ (where $T_{1-1}<T_{2-2}$) and the vaporized fraction of the said first fluid having an exit pressure $P_{1-2}$;

the said pressure $P_{1-2}$ is given a value greater than the minimum exit pressure of the vaporized fraction of-the first fluid needed to allow the plant in which the said heat exchanger is mounted to operate; and the height h of the heat exchange passages and the temperature $T_{2-2}$ of the said second fluid are chosen in such a way that at least one of the two following conditions is fulfilled:

the height h of the said heat exchange passages is at least equal to 2.5 m; and the temperature $T_{2-2}$ of the said second fluid is less than $T_{1-1}$+1.2° C.

It will be understood that this process makes it possible to improve the characteristics of the bath heat exchanger as was already explained in connection with the above definition of the bath heat exchanger according to the invention.

Preferably, the temperature $T_{2-2}$ of the second fluid is between $T_{1-1}$+1.2° C. and $T_{1-1}$+0.4° C.

According to a preferred embodiment, the exit pressure of the first fluid $P_{1-2}$ is about 4 bar absolute, or higher.

According to another characteristic, the height of the passages for heat exchange between the two fluids is preferably at least equal to 3 m.

Preferably, the passages for heat exchange between the two fluids are bounded by parallel plates these possibly being of the type with brazed fins.

According to a variant embodiment, the passages may consist of tubes.

According to a first embodiment, the vessel-forming means comprise a single vessel which contains the said heat exchange passages and through which the first fluid flows by thermosiphon effect.

According to a second embodiment, the vessel-forming means comprise a first vessel defining a lower volume for the entry of the first fluid and an upper volume for the exit of the first fluid and a second vessel connected to the upper and lower volumes respectively, this second vessel possibly being reduced to a pipe.

Further features and advantages of the invention will become more apparent on reading the description which follows of several embodiments of the invention, given by way of non-limiting examples. The description refers to the appended figures in which:

FIG. 1, already described, is a simplified view of a known bath heat exchanger;

FIG. 2, already described, shows the heat exchange diagram for the bath heat exchanger of FIG. 1;

Figure 1:
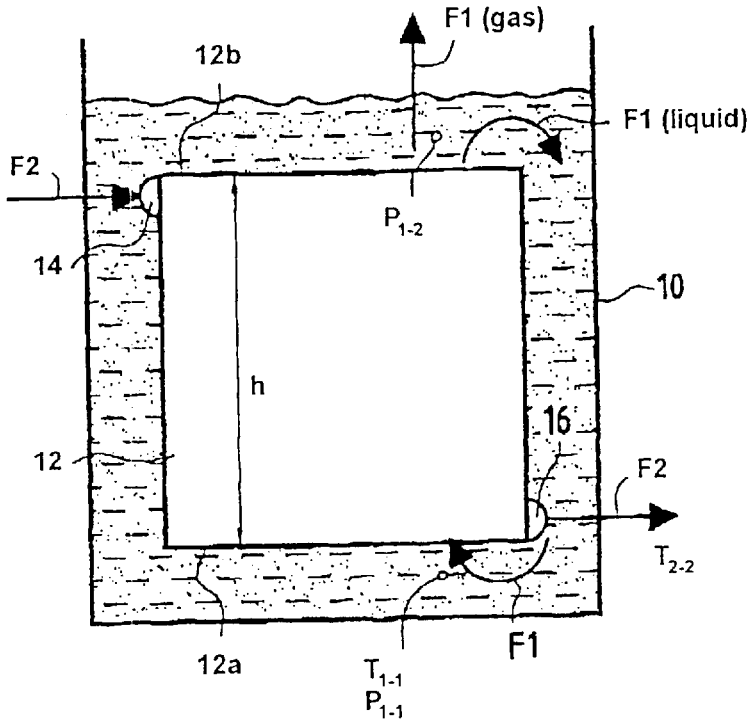
Figure 2:
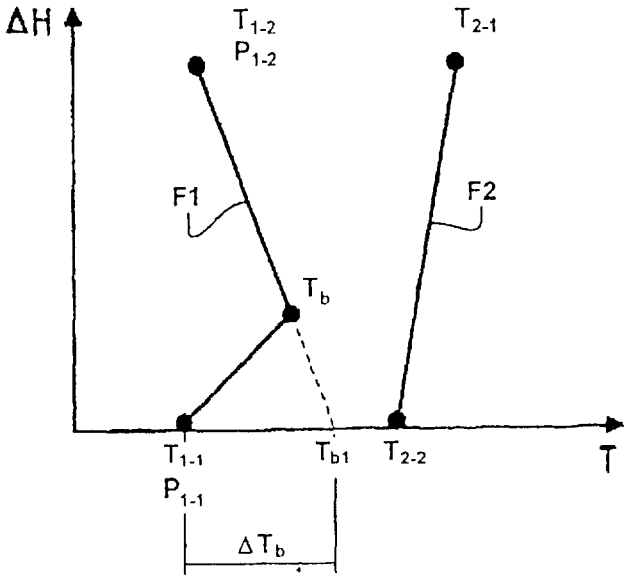
Figure 3:
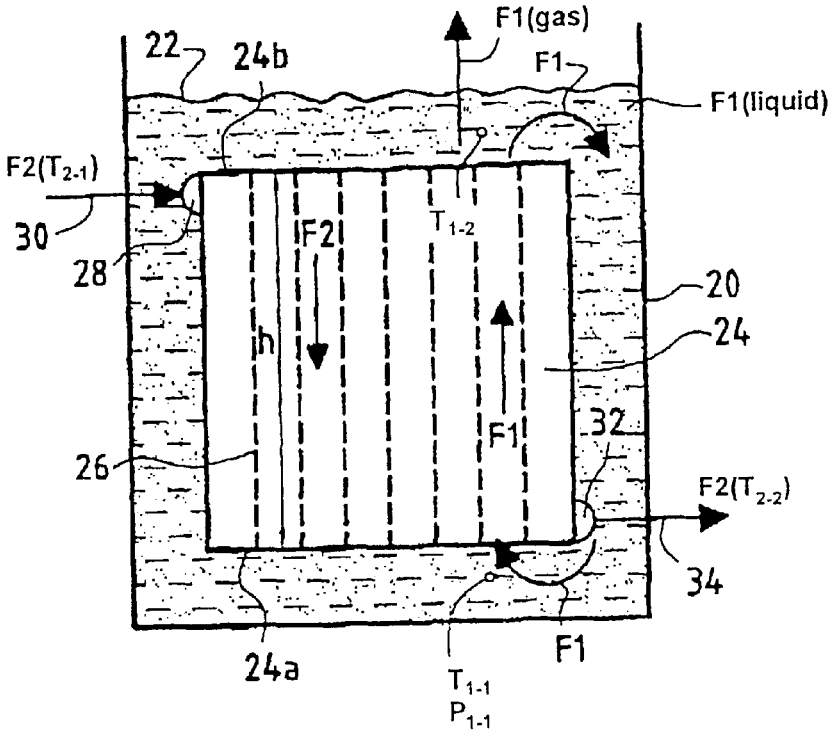
FIG. 3 shows a first embodiment of a bath heat exchanger according to the invention, used in the distillation of air.

A first embodiment of the bath heat exchanger according to the invention will be described first of all with reference to FIGS. 3 and 4. In the description which follows, the case in which the cold fluid to be vaporized is liquid oxygen and the warm fluid is gaseous nitrogen will more particularly be considered, this being the case, for example, in the cryogenic distillation of the gases in air, with an arrangement of the double-column type. However, it goes without saying that the present invention may be applied to heat exchange between two other fluids, for example to the cryogenic separation of synthesis gases, such as methane, carbon monoxide, hydrogen, etc.

A first embodiment of the bath heat exchanger will be described firstly with reference to FIGS. 3 and 4. The external vessel 20 containing the first fluid F1 which, in the example in question, is pure oxygen, has been depicted. In the upper part of the vessel 20 is the interface -22 between the first fluid F1 in liquid form and the fluid F1 in vapour form, recovered from the upper part of the vessel. Inside this vessel is a heat exchange module 24 which defines, in a manner known per se, passages 26 for the "warm" second fluid F2 which, in the example in question, is pure nitrogen, these passages lying between an inlet box 28 connected to the inlet pipe 30 and an outlet box 32 connected to the outlet pipe 34. These passages, as is known, may consist of tubes or of parallel plates defining the circuit for the second fluid. These passages may be vertical, as shown in FIG. 3, horizontal or oblique. The heat exchange module 24 also defines vertical passages for the flow of the first fluid F1, that is to say of the oxygen.

As already indicated, in this type of bath heat exchanger the fluid F1 to be vaporized flows by thermosiphon effect through the vertical heat exchange passages. The fluid F1 has, at its inlet, that is to say at the lower end 24*a* of the exchange module, a temperature $T_{1-1}$ and a pressure $P_{1-1}$ and a temperature $T_{1-2}$ and a pressure $P_{1-2}$ at the upper end 24*b* of the exchange module. The total height of the exchange module, that is to say the flow length of the first fluid between the inlet end 24*a* and the outlet end 24*b*, is called h.

The second fluid, which is gaseous nitrogen in the example in question, enters at the temperature $T_{2-1}$ via the pipe 30 and leaves the exchange module in liquid form at the temperature $T_{2-2}$.

Figure 4:
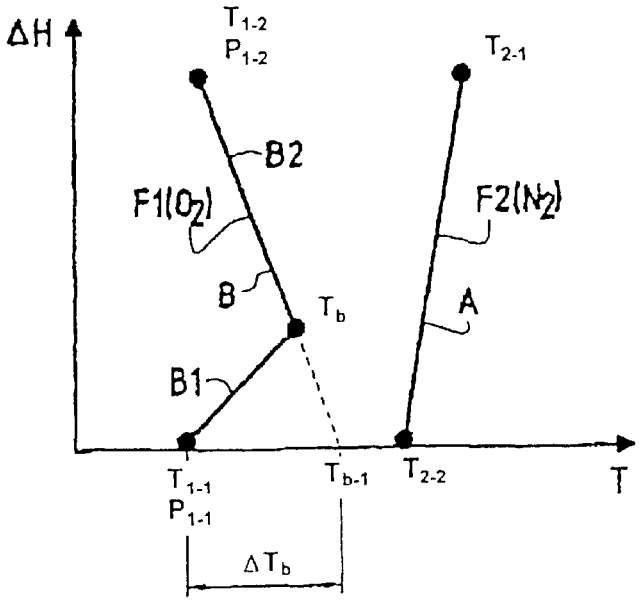
FIG. 4 is a heat exchange diagram showing the operation of the bath heat exchanger of FIG. 3.

FIG. 4 shows the heat exchange between the fluid F1 (pure oxygen) and the fluid F2 (pure nitrogen). Curve A, which is approximately vertical because the fluid F2 is pure nitrogen, shows the change in this fluid between its entry into the exchange module and its exit therefrom. Curve B shows the change in the first fluid (pure oxygen). It has a first part B1 corresponding to the "desubcooling" of the oxygen and a part B2 for partial vaporization of the oxygen above the oxygen bubble temperature $T_b$.

As already explained, by increasing the exit pressure $P_{1-2}$ of the first fluid it is possible to reduce the "pinching effect", thereby making it possible to increase the exchange height h and/or to reduce the temperature difference $T_{2-2}-T_{1-1}$.

In the case of the cryogenic distillation of the gases in air with an arrangement of the double-column type, the exit pressure $P_{1-2}$ of the first fluid (oxygen) depends on the exit pressure of the complete plant containing the bath heat exchanger, taking into account the head loss due to the apparatus between the outlet of the heat exchanger and the outlet of the complete plant. If the outlet of the plant is at atmospheric pressure, the pressure at the outlet of the bath heat exchanger is about 1.3 bar absolute.

It goes without saying that, in order to increase the exit pressure $P_{1-2}$ of the first fluid, it is necessary to increase the pressure of the warm fluid F2 and consequently the pressure of the gas (for example air) at the inlet of the plant.

If a pressure $P_{1-2}$ of 4 bar absolute is allowed, it is possible to construct a bath heat exchanger in which the height h of the exchange module is equal to 3 or 4 metres, keeping a temperature difference of about 1.2° C.

With the same exit pressure of 4 bar absolute and keeping a height h of 2 metres, it is possible to reduce the temperature difference to 0.4 or 0.5° C.

Figure 5:
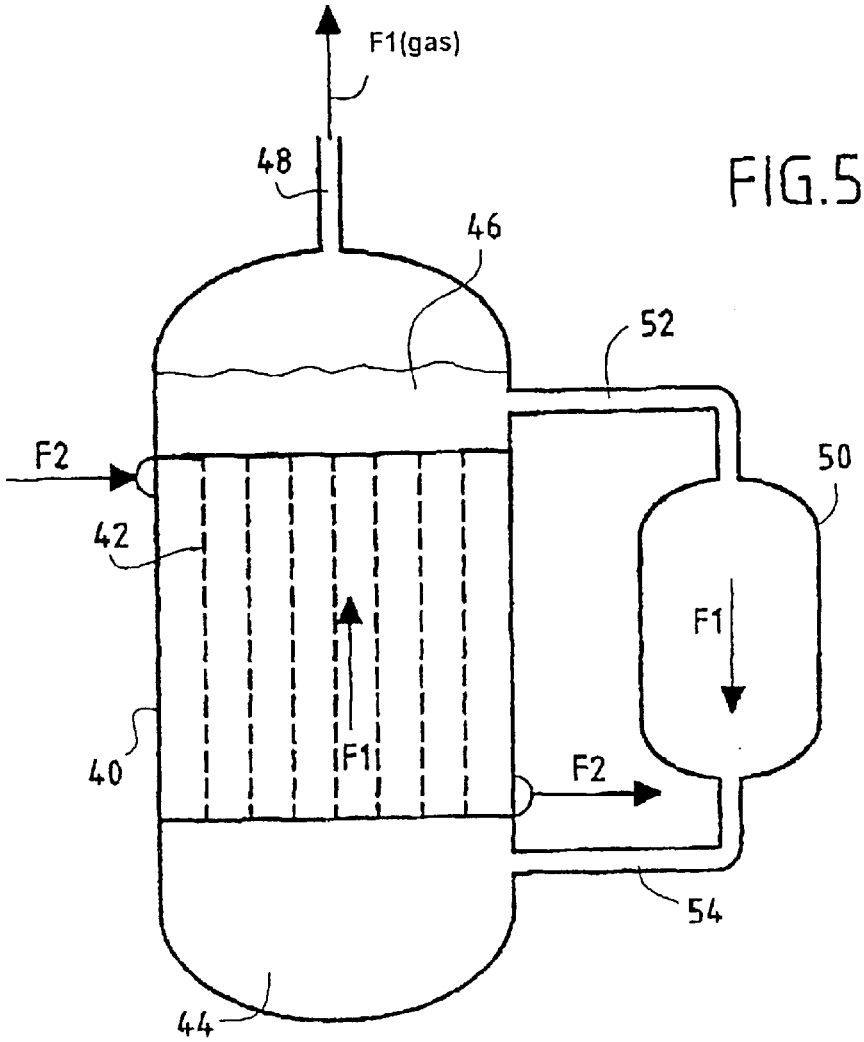
FIG. 5 shows a variant embodiment of the bath heat exchanger according to the invention.

FIG. 5 shows one alternative embodiment of the bath heat exchanger.

The heat exchanger comprises a main vessel 40 in which the exchange module 42 is mounted. The vessel 40 also defines a lower chamber 44 for the entry of the first fluid and an upper chamber 46 for the exit of the first fluid with a take-off 48 for the vaporized first fluid. The heat exchanger also includes a vessel 50 for recirculating the first fluid essentially in the liquid state, which vessel 50 is connected to the upper and lower chambers via pipes 52 and 54. This vessel could simply amount to a pipe.

Figure 6:
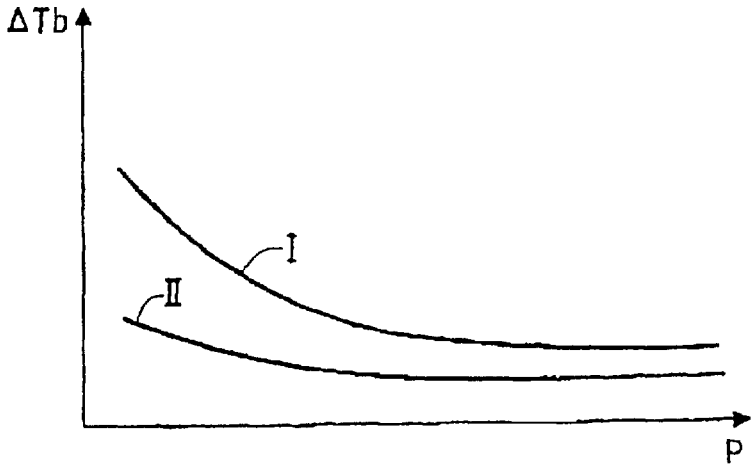
FIG. 6 shows curves of the variation in subcooling as a function of the pressure of the liquid for a net positive suction head of 1 metre.

FIG. 6 shows the variations $\Delta T_b$ of the subcooling caused by a net positive suction head of 1 m as a function of the pressure P for pure oxygen (curve I) and for pure methane (curve II). It may be seen that the higher the pressure (P), the lower the subcooling effect. These curves make it possible to more clearly understand the favourable effect of the increase in pressure of the first fluid on the "pinching effect". This is because the higher the exit pressure $P_{1-2}$, the more the exchange height h, that is to say the hydrostatic pressure $(P_{1-2}-P_{1-1})$, can be increased while keeping the same variation in the subcooling $\Delta T_b$.

What is claimed is:

1. Process for vaporizing a first fluid using a reboiler/condenser bath heat exchanger located in a bath of the first fluid, comprising the following steps:

flowing a second fluid to be condensed through vertical heat exchange passages, said second fluid having an exit temperature $T_{2-2}$;

flowing the first fluid from the bottom up over a height h by thermosiphon effect between the heat exchange passages, said first fluid having an entry temperature $T_{1-1}$, where $T_{1-1}$ is less than $T_{2-2}$ and a vaporized fraction of said first fluid having an exit pressure $P_{1-2}$;

pressurizing the first fluid having an entry pressure $P_{1-1}$ to a value such that the exit pressure $P_{1-2}$ is greater than the minimum exit pressure $P_{m,ex}$ of the vaporized fraction of the first fluid needed to allow a plant in which the reboiler/condenser bath heat exchanger is mounted to operate; and selecting the height h of the heat exchange passages and the temperature $T_{2-2}$ of the second fluid such that at least both of the two following conditions are fulfilled:

the height h of said heat exchange passages is at least equal to 2.5 m; and the temperature $T_{2-2}$ of said second fluid is less than $T_{1-1}$+1.2° C.

2. The process according to claim 1, wherein the minimum pressure $P_{m,ex}$ is about 1.3 bar absolute, and the exit pressure $P_{1-2}$ of the first fluid to be vaporized is about 4 bar absolute, or higher.

3. The process according to claim 1, wherein the height of the heat exchange passages is at least equal to 3 meters.

4. The process according to claim 1, wherein the temperature $T_{2-2}$ of the second fluid is between $T_{1-1}$+1.2° C. and $T_{1-1}$+0.4° C.

5. The process according to claim 1, wherein the heat exchange passages are bounded by parallel plates.

6. The process according to claim 5, wherein the parallel plates include brazed fins.

7. The process according to claim 1, wherein the heat exchange passages are tubes.

8. The process for vaporizing a first fluid, which comprises:

providing a reboiler/condenser bath heat exchanger, for heat exchange between the first fluid to be vaporized and a second fluid to be condensed, said heat exchanger having a minimum exit pressure $P_{m,ex}$ of the first fluid in order to allow a plant in which the heat exchanger is mounted to operate, said heat exchanger including a number of vertical heat exchange passages;

flowing the second fluid through the vertical heat exchange passages, the second fluid having an outlet temperature $T_{2-2}$ at the outlet of the passages;

flowing the first fluid by a thermosiphon effect between the heat exchange passages from the bottom upwards over a height h, the first fluid having an entry temperature $T_{1-1}$ where $T_{1-1}$ is less than $T_{2-2}$, and the vaporized first fluid having an exit pressure $P_{1-2}$;

pressurizing the first fluid having an entry pressure $P_{1-1}$ to a value such that the exit pressure $P_{1-2}$ of the first fluid is greater than the minimum pressure $P_{m,ex}$; and selecting the height of the heat exchange passages and the temperature $T_{2-2}$ of the second fluid such that at least both of the two following conditions are fulfilled:

the height h of the heat exchange passages is at least equal to 2.5 m; and the outlet temperature $T_2$ of the second fluid is less than $T_{1-1}$+1.2° C.

* * * * *

UNITED STATES PATENT AND TRADEMARK OFFICE

CERTIFICATE OF CORRECTION

PATENT NO. : 6,761,213 B2
DATED : July 13, 2004
INVENTOR(S) : Benoît Davidian

It is certified that error appears in the above-identified patent and that said Letters Patent is hereby corrected as shown below:

Title page,
Insert Item:
-- [30] Foreign Application Priority Data
April 13, 2000 (FR) ……..0004765 --.

Signed and Sealed this

Seventeenth Day of August, 2004

JON W. DUDAS
*Acting Director of the United States Patent and Trademark Office*